US005156392A

United States Patent [19]

Wong et al.

[11] Patent Number: 5,156,392

[45] Date of Patent: Oct. 20, 1992

[54] MOVING EDGE SIDE REGISTRATION DEVICE

[75] Inventors: Lam F. Wong, Fairport; David M. Attridge, Rochester, both of N.Y.

[73] Assignee: Xerox Corporation, Stamford, Conn.

[21] Appl. No.: 774,502

[22] Filed: Oct. 10, 1991

[51] Int. Cl.[5] ..... B65H 9/16

[52] U.S. Cl. ..... 271/251

[58] Field of Search ..... 271/248-252

[56] References Cited

U.S. PATENT DOCUMENTS

| | | | |
|---|---|---|---|
| 3,614,092 | 10/1971 | Moos et al. | 271/250 |
| 3,642,274 | 2/1972 | Herrington et al. | 271/79 |
| 4,111,412 | 9/1978 | Cathers | 271/251 |
| 4,165,870 | 8/1979 | Fallon et al. | 271/250 |
| 4,432,541 | 2/1984 | Clark et al. | 271/251 |
| 4,669,719 | 6/1987 | Frantangelo | 271/251 |
| 4,744,555 | 5/1988 | Naramore et al. | 271/251 |
| 4,889,240 | 12/1989 | Sato et al. | 271/251 |
| 5,048,817 | 9/1991 | Roller | 271/250 |
| 5,065,998 | 11/1991 | Salomon | 271/251 |

*Primary Examiner*—Robert P. Olszewski
*Assistant Examiner*—Steven M. Reiss
*Attorney, Agent, or Firm*—Kevin R. Kepner

[57] ABSTRACT

An apparatus in which a sheet is registered during the movement thereof. The sheet is moved along a path in a forward direction of movement and a lateral force is applied thereto. The lateral force causes the sheet edge to engage a moving registration edge at which time the lateral motion is discontinued and the sheet continues along its path with virtualy no loss of velocity. As a result of the movement of the registration guide the relative velocity between the sheet and the guide is zero thereby substantially eliminating wear to the guide.

18 Claims, 3 Drawing Sheets

MOVING EDGE SIDE REGISTRATION DEVICE

This invention relates generally to a sheet registration system, and more particularly concerns a passive moving edge lateral registration system for use in an electrophotographic printing machine.

In a typical electrographic printing process a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, the copy sheet is transported throughout various stations within the copy machine. In a typical registration transport, a force is applied on the copy sheets to move them to a fixed registration edge as the sheets are simultaneously moved through the machine. Proper registration is necessary at various points throughout the electrophotographic process. Proper registration is necessary in document handling, either in the pre-platen or post-platen stage or in the pre-scan or post-scan stage. It is also necessary in the copy paper handling section of the machine to ensure proper transfer of the image and in the area of any compiler or finisher in a machine system.

In a typical registration transport system, a force is applied on the copy sheets or the documents to move them to a fixed registration edge. The driving force can be furnished by either a cross-roll device, a pinch roll, an angled ball on a belt or other similar type devices. With any of the above-type mechanisms, the driving force must be designed such that when the copy sheet engages the registration edge it can slip in the drive nip before it buckles. However, as the sheet slips, it must also continue to move forward through the various steps of the process in the machine. In such transports there is a delicate balance of forces whenever a wide range of sheet weights must be handled. There have been various attempts made to design a system that automatically adjusts the drive force as a function of the sheet weight. All of these systems, however, have used a fixed edge registration type system.

The following disclosures may be relevant to various aspects of the present invention:

U.S. Pat. No. 4,432,541
Patentee: Clark, et al.
Issued: Feb. 21, 1984

U.S. Pat. No. 3,642,274
Patentee: Harrington, et al.
Issued: Feb. 15, 1972

U.S. Pat. No. 4,744,555
Patentee: Naramore, et al.
Issued: May 17, 1988

U.S. application Ser. No. 07/629,866
Inventor: Salomon.
Filed: Dec. 19, 1990

The relevant portions of the foregoing disclosures may be briefly summarized as follows:

U.S. Pat. No. 4,432,541 discloses an apparatus consisting of a drive roll that is skewed in the direction away from the fixed side edge guide driving an idler roll that is skewed at a greater angle toward the side edge guide whereby when the sheet moves between the drive roll and the guide roll, it is laterally driven by the small idler roller to the edge guide and due to the greater coefficient of friction of the idler roller is held against the edge as it is driven forward by the drive roll. The skewing of the drive roll is provided to reduce the chance of damage to the sheet as it is laterally driven by the idler roller.

U.S. Pat. No. 342,274 discloses an inverter roll consisting of dislike end members with axial rods spaced around the circumference of the cagelike skeletal roller assembly on which small rollers are positioned. The small rollers are co-axially parallel with the main shaft of the large roller and are independently rotatable about their axes.

U.S. Pat. No. 4,744,555 discloses an idler roller pair mounted on a common shaft and spaced from one another to define a gap therebetween. The idler roller pairs are positioned in conjunction with a drive roller so that the drive roller occupies the space between the idler rollers. The idler roller pairs are skewed so that the longitudinal axis of the respective drive shafts is at a transverse angle with respect to the registration edge mounted on the side of a tray. As a sheet passes through the gap between the drive roller and its pair of idler rollers, it is urged to the registration edge whereupon it continues in the sheet feed direction.

U.S. application Ser. No. 07/629,866 discloses a lateral sheet registration system utilizing a feed drum with an axis of rotation at an angle less than perpendicular to the feed direction so as to impart a lateral force on a sheet as well as a force in the main feed direction. Small, freely rotatable rollers are mounted on the periphery of the drum so that their axis of rotation is parallel to the main feed direction.

All of the above described patents, the application and the references therein utilize a fixed edge registration guide. One disadvantage of the fixed edge registration guide is the wear to the guide caused by the relative velocity between the sheets and the guide. Another disadvantage of the fixed edge registration guide is the damage potential to the sheets as a result of the lateral driving means continuing to act upon the sheet after it reaches the registration guide.

In accordance with one aspect of the present invention, there is provided an apparatus for registering a sheet during the movement thereof. The apparatus includes a rotating registration edge. Means move the sheet along a predetermined path having a forward direction of movement and a lateral direction of movement substantially normal to the forward direction of movement. The lateral movement of the sheet causes the side edge of the sheet to engage the rotating registration edge so as to be aligned thereat. Once the sheet is aligned, the lateral moving means ceases to impart any lateral or side motion upon the sheet itself thereby preventing damage to the sheet. The sheet continues in the forward sheet feeding direction with virtually no loss of velocity.

Pursuant to another aspect of the present invention, there is provided a relatively simple, passive registration means which insures no damage to the sheet while maintaining sheet velocity along the paper path.

Other aspects of the present invention will become apparent as the following description proceeds at upon reference to the drawings in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
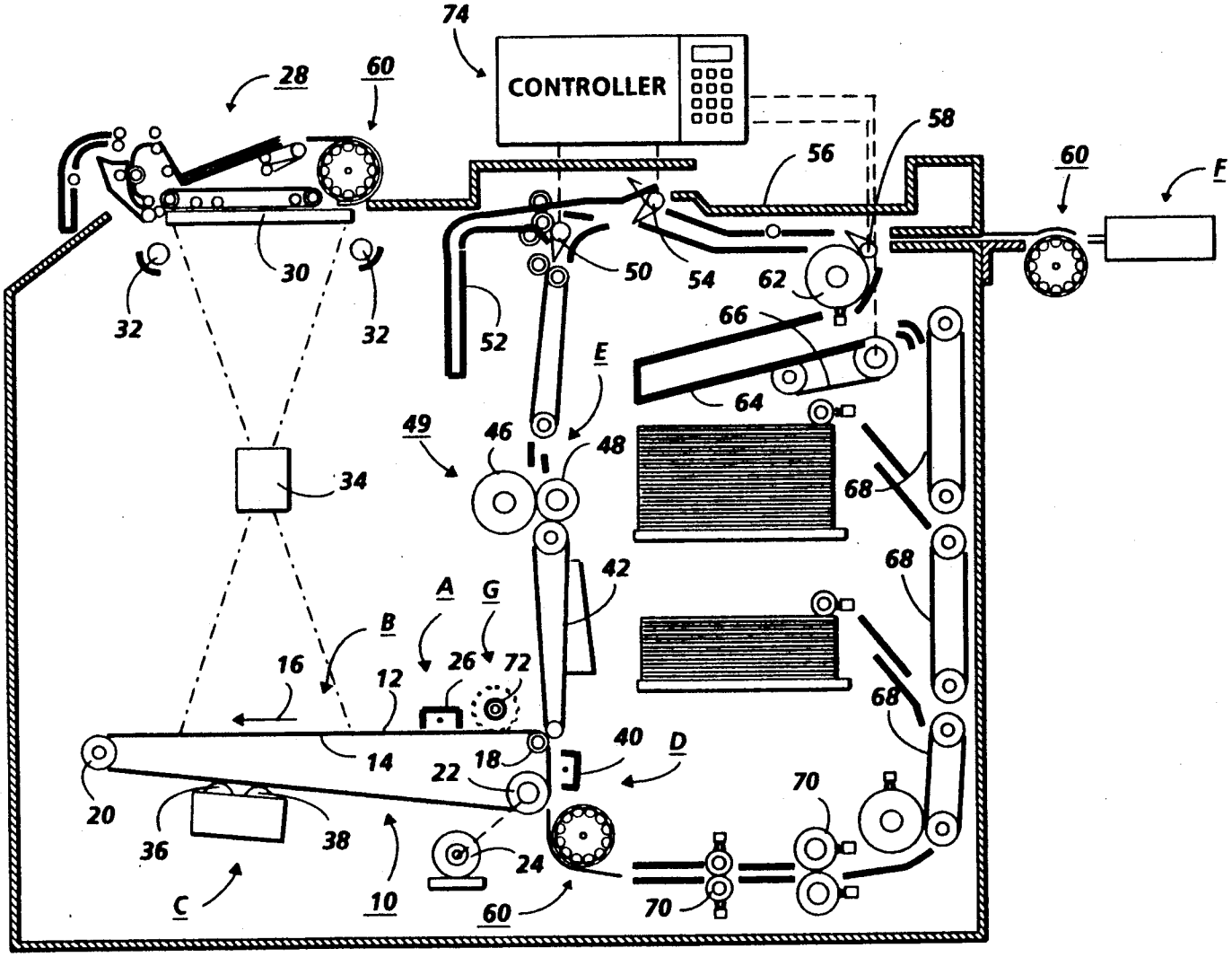
FIG. 1 is a schematic elevational view depicting an illustrative electrophotographic printing machine incorporating several applications of the sheet transport and registration apparatus of the present invention therein.

For a general understanding of the features of the present invention, reference is made to the drawings. In the drawings, like reference numerals have been used to identify identical elements. FIG. 1 schematically depicts an electrophotographic printing machine incorporating the features of the present invention therein. It will become evident from the following discussion that the sheet transport and registration apparatus of the present invention may be employed in a wide variety of devices and is not specifically limited in its application to the particular embodiment depicted herein.

Referring to FIG. 1 of the drawings, the electrophotographic printing machine employs a belt 10 having a photoconductive surface 12 deposited on a conductive substrate 14. Preferably, photoconductive surface 12 is made from a selenium alloy with conductive substrate 14 being made from an aluminum alloy. Other suitable photoconductive materials and conductive substrates may also be employed. Belt 10 moves in the direction of arrow 16 to advance successive portions of photoconductive surface 12 sequentially through the various processing stations disposed about the path of movement thereof. Belt 10 is entrained about stripping roller 18, tensioning roller 20, and drive roller 22. Stripping roller 18 is mounted rotatably so as to rotate with belt 10. Tensioning roller 20 is resiliently urged against belt 10 to maintain belt 10 under the desired tension. Drive roller 22 is rotated by motor 24 coupled thereto by suitable means such as a belt drive. As roller 22 rotates, it advances belt 10 in the direction of arrow 16.

Initially, a portion of photoconductive surface 12 passes through charging station A. At charging station A, a corona generating device, indicated generally by the reference 26 charges photoconductive surface 12 to a relatively high, substantially uniform potential.

Next, the charged portion of photoconductive surface 12 is advanced through imaging station B. At imaging station B, a document handling unit, indicated generally by the reference numeral 28, is positioned over platen 30 of the printing machine. Document handling unit 28 sequentially feeds documents from a stack of documents placed by the operator face up in a normal forward collated order in the document stacking and holding tray. A document feeder located below the tray forwards the bottom document in the stack to a pair of take-away rollers. The bottom sheet is then fed by the rollers to a document transport and registration apparatus 60 of the present invention to a feed roll pair and belt. The belt advances the document to platen 30. After imaging, the original document is fed from platen 30 by the belt into a guide and feed roll pair. The document then advances into an inverter mechanism and back to the document stack through the feed roll pair. A position gate is provided to divert the document to the inverter or to the feed roll pair. Imaging of a document is achieved by lamps 32 which illuminate the document on platen 30. Light rays reflected from the document are transmitted through lens 34. Lens 34 focuses light images of the original document onto the charged portion of photoconductive surface 12 of belt 10 to selectively dissipate the charge thereon. This records an electrostatic latent image on photoconductive surface 12 which corresponds to the informational area contained within the original document. Thereafter, belt 10 advances the electrostatic latent image recorded on photoconductive surface 12 to development station C.

At development station C, a pair of magnetic brush developer rolls indicated generally by the reference numerals 36 and 38, advance developer material into contact with the electrostatic latent image. The latent image attracts toner particles from the carrier granules of the developer material to form a toner powder image on photoconductive surface 12 of belt 10. Belt 10 then advances the toner powder image to transfer station D.

Prior to reaching transfer station D, a copy sheet is placed in proper lateral edge alignment by the transport and registration apparatus 60 of the present invention. At transfer station D, a copy sheet is moved into contact with the toner powder image. Transfer station D includes a corona generating device 40 which sprays ions onto the backside of the copy sheet. This attracts the toner powder image from photoconductive surface 12. After transfer, conveyor 42 advances the copy sheet to fusing station E.

Fusing station E includes a fuser assembly, indicated generally by the reference numeral 49, which permanently affixes the transferred toner powder image to the copy sheet. Preferably, fuser assembly 49 includes a heated fuser roller 46 and a back-up roller 48 with the powder image on the copy sheet contacting fuser roller 46. In this manner, the powder image is permanently affixed to the copy sheet.

After fusing, the copy sheets are fed to gate 50 which functions as an inverter selector. Depending upon the position of gate 50, the copy sheets are deflected to sheet inverter 52 or bypass inverter 52 and are fed directly to a second decision gate 54. At gate 54, the sheet is in a face-up orientation with the image side, which has been fused, face up. If inverter path 52 is selected, the opposite is true, i.e. the last printed side is face down. Decision gate 54 either deflects the sheet directly into an output tray 56 or deflects the sheet to decision gate 58. Decision gate 58 may divert successive copy sheets to duplex inverter roll 62, or onto a transport path having the sheet transport and registration apparatus of the present invention, indicated generally the reference numeral 60. Sheet transport and registration apparatus 60 registers and transports successive copy sheets to finishing station F. At finishing station F, copy sheets are stacked in a compiler tray and attached to one another to form sets. The sheets are attached to one another by either a binding device or a stapling device. In either case, a plurality of sets of documents are formed in finishing station F. When decision gate 58 diverts the sheet onto inverter roll 62, roll 62 inverts and stacks the sheets to be duplexed in duplex tray 64. Duplex tray 64 provides an intermediate or buffer storage for those sheets that have been printed on one side and on which an image will be subsequently printed on the second, opposed side thereof, i.e. the sheets being duplexed. The sheets are stacked in duplex tray face down on top of one another in the order in which they are copied.

In order to complete duplex copying, the simplex sheets in tray 64 are fed, in seriatim, by bottom feeder 66 from tray 64 back to transfer station D via conveyors 68, rollers 70, and the transport and registration apparatus 60 for transfer of the toner powder image to the opposed sides of the copy sheets. Inasmuch as successive bottom sheets are fed from duplex tray 64, the proper or clean side of the copy sheet is positioned in contact with belt 10 at transfer station D so that the toner powder image is transferred thereto. The duplex sheet is then fed through the same path as the simplex sheet to be stacked in tray 56 or, when the finishing operation is selected, to be advanced by sheet transporting and registering apparatus 60 to finishing station F.

Invariably, after the copy sheet is separated from photoconductive surface 12 of belt 10, some residual particles remain adhering thereto. These residual particles are removed from photoconductive surface 12 at cleaning station G. Cleaning station G includes a rotatably mounted fibrous or electrostatic brush 72 in contact with photoconductive surface 12 of belt 10. The particles are cleaned from photoconductive surface 12 of belt 10 by the rotation of brush 72 in contact therewith. Subsequent to cleaning, a discharge lamp (not shown) floods photoconductive surface 12 to dissipate any residual electrostatic charge remaining thereon prior to the charging thereof for the next successive imaging cycle.

The various machine functions are regulated by a controller 74. Controller 74 is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, controller 74 regulates the various positions of the decision gates depending upon the mode of operation selected. Thus, when the operator selects the finishing mode, either an adhesive binding apparatus and/or a stapling apparatus will be energized and the decision gates will be oriented so as to advance either the simplex of duplex copy sheets to sheet transporting and registering apparatus 60, which, in turn transports the copy sheet to the compiler tray at finishing station F. The detailed operation of sheet transporting and registering apparatus 60 will be described hereinafter with reference to FIGS. 2 through 4, inclusive.

Figure 2:
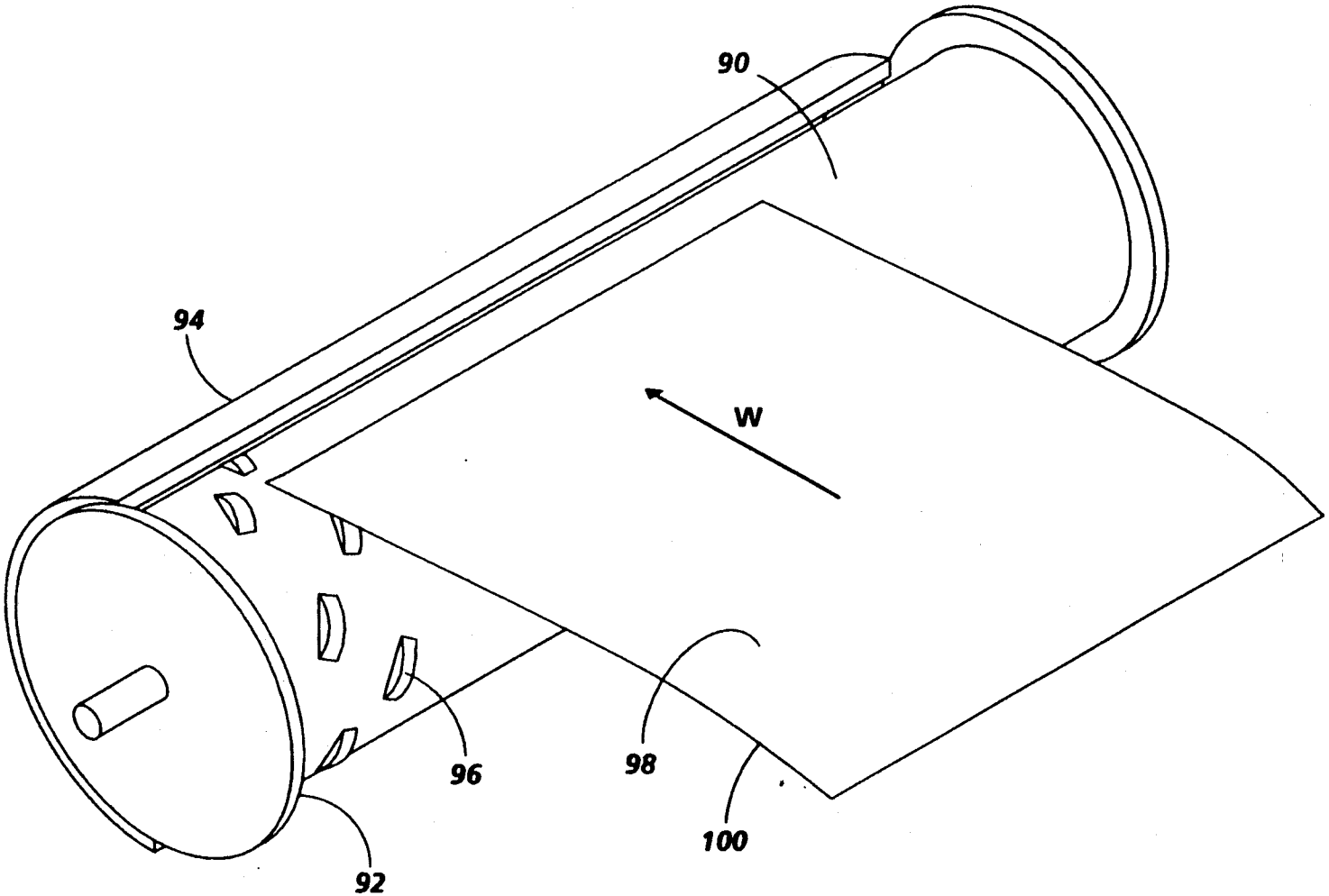
FIG. 2 is a perspective view of an embodiment of the sheet transport and registration apparatus.

Referring now to FIG. 2, the features of the sheet transport and registration device will be described in greater detail. As shown thereat, sheet transporting and registering apparatus includes a main driving drum 90, a moving registration guide 92 affixed to the drum 90, a sheet guide or baffle 94 and small skew rollers 96 mounted to the drum 90.

The main driving drum 90 is rotatably driven about its axis of rotation, which axis of rotation is perpendicular to the sheet feeding direction shown as arrow W. A curved baffle 94 is mounted in close proximity to the drum 90 so as to provide a normal force to the sheet 98 being transported. As the sheet 98 enters the opening between the drum 90 and the baffle 94 it is contacted by the skew rollers 96. As the sheet 98 is pulled in the direction of drum rotation, the skew rollers 96 are free to rotate in the opposite direction thereby impacting a force lateral to the sheet feeding direction W to the sheet 98. The sheet 98 is transported both laterally and in the main feed direction W until its edge 100 contacts the moving registration guide 92. When the sheet edge 100 contacts the guide 92, the skew rollers 96 cease to roll and lateral motion of the sheet ceases.

Figure 3:
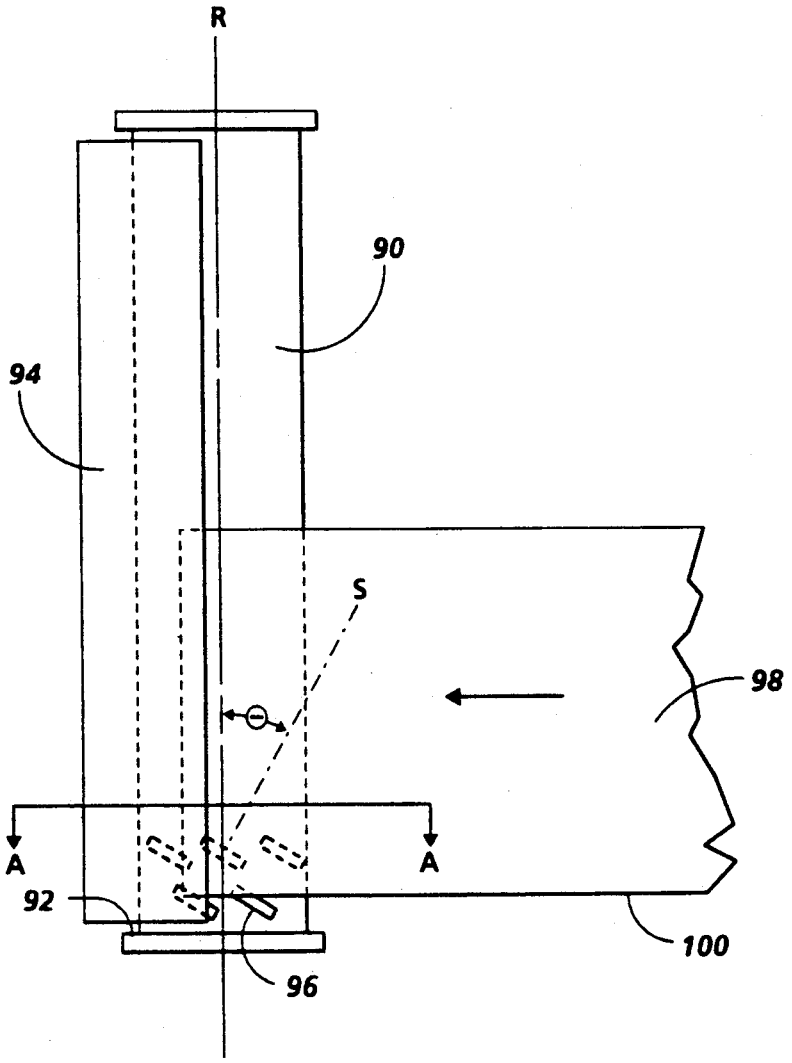
FIG. 3 is a top elevational view showing the orientation of the skew rollers and the main sheet feeding drum of the sheet transport and registration apparatus.

Turning now to FIG. 3, the orientation of the skew roller 96 axis of rotation S can be seen with regard to the axis of rotation R of the main feed drum 90 illustrated by angle $\theta$. Two radial rows of skew rollers 96 are illustrated mounted within the main drum 90 so that a portion of the skew roller 96 protrudes above the circumferential surface 102 of the feed drum 90. Ideally, the skew rollers 96 are constructed of an elastomeric substance with a high coefficient of friction to achieve a positive grip on the feed sheet 98. Similarly, the sheet guide or baffle 94 is constructed of a smooth material with a low coefficient of friction to reduce sheet drag. As the sheet 98 enters the gap between the feed roll 90 and baffle 94 it is gripped by the skew rollers 96, which are free to rotate independently on their axes. As the sheet 98 is fed by the feed roll 90, the rotation of the skew rollers 96 causes the sheet 98 to be laterally shifted until it contacts the moving registration edge 92. Once the sheet 98 contacts the registration edge 92 the skew rollers 96 cease to rotate and the sheet 98 is driven only in the feed direction W. Thus, cessation of lateral motion prevents damage to the sheet 98. Additionally, as the registration guide 92 is moving at the same speed as the feed drum 90, the relative velocity between the sheet 98 and the guide 92 is zero and guide wear is eliminated.

Figure 4:
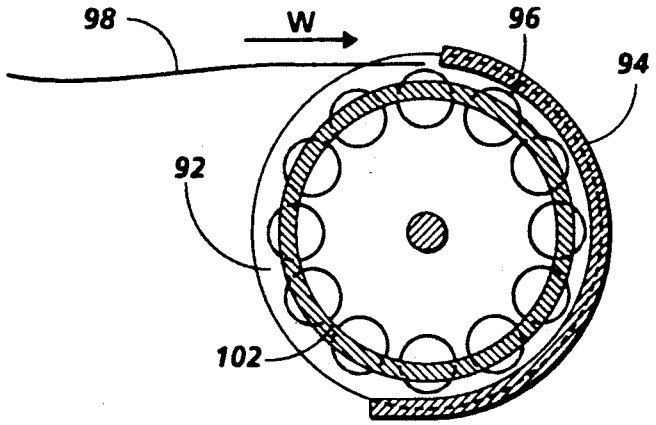
FIG. 4 is a sectional elevational view taken along line A—A of FIG. 3.

Referring now to FIG. 4, there is shown a sectional elevational view along line A—A in FIG. 3 in the direction of the arrows. It can be seen that the two rows of skew rollers 96 are arranged in a manner so as to provide an almost continuous gripping surface around the periphery of the drive drum 90. This arrangement allows the sheets 98 to be gripped, laterally shifted into proper alignment and continue in the feed direction with virtually no loss in sheet velocity.

In recapitulation, the sheet transporting and registration apparatus includes a plurality of small skew rollers mounted in radial rows not axially parallel to the drive drum axis about the periphery of a larger drive drum. A curved baffle is mounted in close proximity to the drive drum to provide a normal force to a sheet driven by the drum. As a sheet enters the gap between the drum and the guide, it is gripped by the small skew rollers which are each independently free to rotate on their own axes. The small skew rollers rotate opposite the feed direction and due to their axial alignment, impart a lateral motion to the sheet. The sheet is driven laterally to the moving registration guide attached to the drive drum at which time the skew rollers cease to rotate. The sheet continues to be driven, now properly aligned, in the main feed direction with virtually no loss of velocity. Furthermore, as the relative velocity between the sheet and the registration guide is zero, edge guide wear is eliminated.

It is, therefore, apparent that there has been provided in accordance with the present invention, a moving side edge registration means that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for driving a sheet in a primary sheet feeding direction and for positive lateral side edge registration of the sheet comprising:

a drum member rotatable about a central axis of rotation substantially perpendicular to the sheet feeding direction so as to rotate primarily in the primary sheet feeding direction;

a plurality of rollers mounted to the periphery of said drum member for engaging the sheets, said rollers are rotatable with said drum member to impart sheet driving forces to the sheets in both the primary sheet feeding direction and the lateral side registration direction as said drum member is rotated in the primary sheet feeding direction, and wherein said rollers are independently rotatable about their own axes, which roller axes are at an acute angle to said drum member;

means for maintaining the sheet in contact with said drum over at least a portion of the movement thereof; and a registration guide adapted to move in unison with said drum, said rollers moving the sheet so that one edge of the sheet moves into engagement with said registration guide.

2. The apparatus of claim 1 wherein said maintaining means comprises an arcuate member disposed axially parallel to said drum member.

3. The apparatus of claim 2 wherein there is no significant slippage between said rollers and the sheet, and wherein there is no significant variation in the primary sheet feeding direction velocity.

4. The apparatus of claim 3 wherein said drum member is rotatably driven on a fixed shaft substantially perpendicular to the primary sheet feeding direction.

5. The apparatus of claim 4 wherein said rollers do not rotate about their own axes after the sheet engages said lateral side guide and said rollers do not slip relative to the sheet.

6. The apparatus of claim 5 wherein said rollers are disposed in a plurality of radial planes and wherein said rollers are offset angularly from one of said radial planes to a second of said planes.

7. The apparatus of claim 6, wherein said plurality of said radial planes equals two.

8. The apparatus of claim 2 wherein said rollers comprise elastomeric rolls having high coefficients of friction.

9. An electrophotographic printing machine of the type in which a sheet is advanced in a primary sheet feeding direction and for positive edge registration, wherein the improvement comprises:

a drum member rotatable about a central axis of rotation substantially perpendicular to the sheet feeding direction so as to rotate primarily in the primary sheet feeding direction;

a plurality of rollers mounted to the periphery of said drum member for engaging the sheets, said rollers are rotatable with said drum member to impart sheet driving forces to the sheets in both the primary sheet feeding direction and the lateral side registration direction as said drum member is rotated in the primary sheet feeding direction, and wherein said rollers are independently rotatable about their own axes, which roller axes are at an acute angle to said drum member;

means for maintaining the sheet in contact with said drum over at least a portion of the movement thereof; and a registration guide adapted to move in unison with said drum, said rollers moving the sheet so that one edge of the sheet moves into engagement with said registration guide.

10. The apparatus of claim 9 wherein said maintaining means comprises an arcuate member disposed axially parallel to said drum member.

11. The apparatus of claim 10 wherein said rollers comprises an elastomeric roll having a high coefficient of friction.

12. The apparatus of claim 11 wherein there is no significant slippage between said rollers and said sheet, and wherein there is no significant variation in the primary sheet feeding direction velocity.

13. The apparatus of claim 12 wherein said drum member is rotatably driven on a fixed shaft substantially perpendicular to the primary sheet feeding direction.

14. The apparatus of claim 13 wherein said rollers do not rotate about their own axes after the sheet engages said lateral side guide and said rollers do not slip relative to said sheet.

15. The apparatus of claim 14 wherein said rollers are disposed in a plurality of radial planes and wherein said rolls are offset angularly from one of said radial planes to a second of said planes.

16. The apparatus of claim 15 wherein said plurality of said radial planes equals two.

17. The apparatus of claim 16 wherein the sheet being fed is a copy sheet.

18. The apparatus of claim 16 wherein the sheet being fed is an original document.

* * * * *